United States Patent [19]

Martin

[11] Patent Number: 4,502,843

[45] Date of Patent: Mar. 5, 1985

[54] VALVELESS FREE PLUNGER AND SYSTEM FOR WELL PUMPING

[75] Inventor: Jack E. Martin, Farmington, N. Mex.

[73] Assignee: Noodle Corporation, Abilene, Tex.

[21] Appl. No.: 392,601

[22] Filed: Jun. 28, 1982

Related U.S. Application Data

[63] Continuation of Ser. No. 135,684, Mar. 31, 1980, abandoned.

[51] Int. Cl.[3] ..... F04B 47/12

[52] U.S. Cl. ..... 417/56; 92/162 R; 92/222

[58] Field of Search ..... 417/56-60, 417/555 R, 555 A, 556, DIG. 1; 92/162 R, 222

[56] References Cited

U.S. PATENT DOCUMENTS

| | | | |
|---|---|---|---|
| 2,246,942 | 6/1941 | Janney et al. | 92/222 |
| 2,508,174 | 5/1950 | Knox et al. . | |
| 2,642,002 | 6/1953 | Knox et al. . | |
| 2,661,024 | 12/1953 | Knox . | |
| 2,699,121 | 1/1955 | Knox . | |
| 2,918,015 | 12/1959 | Knox . | |
| 2,962,978 | 12/1960 | Reeves | 417/56 |
| 2,970,547 | 2/1961 | McMurry . | |
| 3,012,513 | 12/1961 | Knox . | |
| 3,012,832 | 12/1961 | Knox . | |
| 3,031,971 | 5/1962 | Roach . | |
| 3,039,394 | 6/1962 | Brown et al. . | |
| 3,053,188 | 9/1962 | Dinning et al. . | |
| 3,095,819 | 7/1963 | Brown et al. . | |
| 3,122,045 | 2/1964 | Zilberfarb . | |
| 3,181,470 | 5/1965 | Clingman . | |
| 3,303,757 | 2/1967 | Ward . | |
| 3,351,021 | 11/1967 | Moore, Jr. . | |
| 4,007,784 | 2/1977 | Watson et al. | 417/56 X |

FOREIGN PATENT DOCUMENTS

| | | |
|---|---|---|
| 695708 | 8/1940 | Fed. Rep. of Germany . |
| 1439828 | 6/1976 | United Kingdom . |

OTHER PUBLICATIONS

"Vertipig," Ferguson Beauregard, Inc., Route 10, Old Troup Road, Tyler, Texas 75701.

The McLean Expanding Plunger, McLean & Sons, Inc., 4264 Candy Lane, Odessa, Texas 79762.

*Primary Examiner*—Edward K. Look

*Attorney, Agent, or Firm*—Michael A. O'Neil

[57] ABSTRACT

A rugged lightweight valveless plunger (38) is provided for use in a well pumping system of the free plunger type. The plunger (38) comprises an elongated cylindrical integral aluminum body (42) having a rigid sealing section (44) formed by a plurality of circumferential grooves (46) defining a plurality of annular sealing flanges (48). The flanges (48) and grooves (46) are uniform and closely spaced. A pair of annular steel collars (50, 52) are secured to the aluminum body (42) on opposite longitudinal sides of the sealing section (44) and have an outer diameter substantially equal to the outer diameter of the annular sealing flanges (48). The aluminum body provides lightweight and ease of machinability. The collars (50, 52) protect the annular aluminum sealing flanges (48) from frictional wear against the well tubing (20), such that sealing tolerances are maintained over an extended life rating. The plunger (38) is simple in construction and virtually indestructable. There is further provided a simple and efficient overall well pumping system (10) having a minimum of parts and operationally controlled by a singular valve (34).

2 Claims, 2 Drawing Figures

VALVELESS FREE PLUNGER AND SYSTEM FOR WELL PUMPING

This is a continuation of application Ser. No. 135,684 filed Mar. 31, 1980 now abandoned.

TECHNICAL FIELD

The present invention relates to well pumping systems of the free plunger type, and more particularly to an improved valveless free plunger which is simple and economical in manufacture, and which is lightweight yet rugged and durable. The invention further relates to a simplified overall operating system.

BACKGROUND

In the production of oil wells, well fluid may be recovered by the use of a free plunger, sometimes called a gas lift plunger or piston. This type of plunger is freely movable in a string of tubing in the well and travels between the top and bottom of the tubing. The pressure of the gas from the producing formation causes upward movement of the plunger. A slug of liquid from the oil bearing formation which has seeped into the tubing above the plunger is lifted by the plunger to an output flow line at the surface.

The cycling of the plunger is typically controlled by the opening and closing of a motor valve located in the output flow line. With the plunger at the bottom of the tubing resting against an abutment or seating nipple, and with the motor valve closed, formation gas pressure will build up over a period of time. A timing mechanism opens the motor valve after a predetermined time lapse. This establishes a pressure differential across the plunger, and greater pressure beneath the plunger drives the plunger upwardly through the tubing. Upward movement of the plunger forces oil in the tubing above the plunger outwardly through the output flow line. When the plunger reaches the top of the tubing, the motor valve is closed. Pressure across the plunger then equalizes, and the plunger falls by gravity to the bottom of the tubing. The cyclic process then starts over again.

Various types of free plungers have been used. One type of plunger is provided with a passageway therethrough which is opened and closed by a valve. During upward movement of the plunger, the valve is closed so that the interior of the tubing above the plunger is substantially sealed from the interior of the tubing below the plunger. This maintains the gas pressure differential necessary for lifting. During downward movement of the plunger, the valve is open to permit well fluid to flow substantially freely through the passageway.

Another valve-type plunger includes a circumferential, radially expandable section which is expanded (valve closed) into contact with the well tubing during upward movement of the plunger, and is retracted (valve open) during downward movement of the plunger.

While a valve in the plunger is desirable to permit faster descent of the plunger, such valves render the plunger more complex and costly to manufacture. Reliability and ruggedness is also a problem because of the moving parts involved.

Another type of free plunger is the valveless type. Valveless free plungers are typically used in low production wells where it is not necessary to quickly return the plunger to the bottom of the tubing. In a valveless free plunger system, the rate of descent of the plunger is slower because fluid beneath the plunger must flow through the small annular gap between the outer periphery of the plunger and the interior sidewall of the tubing. This annular clearance gap is the same for both ascent and descent. The gap does not widen during descent as in some valve-type plungers, nor is there a bypass passageway during descent as in other valve-type plungers.

Valveless free plungers present special and conflicting problems, particularly in the dimension of the annular clearance gap. There should be a sufficiently tight fit of the plunger within the tubing to afford a sufficiently effective seal during ascent. Yet the gap must be wide enough to allow descent at a rate which is not too slow to be practical. Too loose a fit sacrifices lifting efficiency during ascent; too tight a fit sacrifices descent rate. There is a need for a valveless free plunger which affords enhanced lift capability, yet descends at a practical rate. There is further a need for a valveless free plunger which is simple and economical to manufacture and affords accurate tolerance control.

Another problem encountered is maintenance of sealing tolerances over extended periods of use. The downhole well environment encountered by the plunger together with the close sealing tolerances dictate that the plunger be resistant to the atmosphere of the well and to frictional wear against the interior sidewall of the well tubing. On the other hand, the plunger should not be so heavy and bulky that too much of the lifting force generated by the gas pressure differential is needed just to overcome the weight of the plunger. A need has thus arisen for a valveless free plunger which is lightweight yet durable and wear-resistant to maintain sealing tolerances over an extended life rating.

There is further a need for a plunger of simple yet rugged design and construction. Various prior systems have employed elaborate cushioning or shock-absorbing apparatus at the top and/or bottom of the tubing to protect the plunger upon impact. There is a need to eliminate such auxiliary apparatus by providing a plunger which is virtually indestructible, but yet not so heavy and bulky as to sacrifice lifting efficiency, nor so complex in design and construction as to render it too costly to manufacture.

Another problem is that of making optimum use of the formation gas pressure in generating plunger lift. A need has arisen for a valveless free plunger which is not only lightweight and wear-resistant, but which also makes effective use of gas pressure lift.

There is further a need for a simplified overall operating system of the valveless free plunger type. Pumping systems with auxiliary valving and control apparatus at the surface and/or downhole are complex and costly. There is a need to provide a simple system with a minimum of parts.

SUMMARY OF THE INVENTION

The present invention provides a valveless free plunger which is simple and economical to manufacture.

The plunger is lightweight, yet durable and wear-resistant. The reduced mass of the plunger increases net gas lift. Wear resistance maintains sealing tolerances over an extended life rating, and is afforded without expensive materials or complex construction or design. Lift capability is enhanced, and is maintained over a prolonged life, in a simple and inexpensive device.

The plunger is virtually indestructable, yet does not sacrifice lifting efficiency or economy of manufacture.

In one particular aspect of the invention, there is provided a plunger groove and flange structure making effective use of gas pressure lift. This further enhances lift capability of the plunger.

The plunger has an elongated cylindrical body with a grooved rigid sealing section. A pair of wear-resistant collars are secured to the body on opposite longitudinal sides of the sealing section and have substantially the same diameter as the sealing section. The body is an integral member of lighter weight material than the collars. The collars provide wear resistance against the interior sidewall of the tubing to prevent the sealing section of the body from being frictionally worn away. Sealing tolerances are maintained over significantly extended periods of use. Furthermore, this maintenance of tolerances affords accurate descent characteristics of the plunger.

In the preferred embodiment, an elongated cylindrical aluminum body has an integral sealing section formed by a plurality of circumferential grooves defining a plurality of annular flanges. A pair of annular steel collars are secured to the aluminum body on opposite longitudinal sides of the sealing section and have an outer diameter substantially equal to the outer diameter of the annular sealing flanges.

This aluminum and steel construction is economical to manufacture, as well as providing improved performance characteristics. The aluminum body provides both lightweight and ease of machinability. The steel collars provide wear resistance and protect the annular aluminum sealing flanges. Initially set tolerances are maintained over an extended life span.

In one particular aspect of the preferred embodiment, there is afforded groove and flange structure making effective use of gas pressure lift. The flanges and grooves are closely spaced to incease the number thereof per unit longitudinal length of the aluminum body. The flanges have the same width as the grooves. The grooves have curved inner surfaces, and the radius of curvature of these surfaces is substantially one-half the groove width. Sealing characteristics are enhanced, and cumulative upper groove surface area is optimized, providing further improved performance all in a simple and economically manufacturable device.

The integral aluminum body includes a fishing neck section proximate one of the steel collars and of reduced outer diameter. The aluminum body has a curved transition section of increasing diameter from the fishing neck section to the one collar. This collar has a curved transition section of decreasing outer diameter to meet the curved transition section of the aluminum body in smooth profile. A steel neck cap is secured to the other end of the fishing neck section and has a greater outer diameter than the fishing neck section. A fishing tool may be lowered on a wireline for hooking the steel neck cap, to afford emergency retrieval.

The invention further provides a simple and efficient overall well pumping system of the valveless free plunger type. The system has a minimum number of parts and is operated by a single valve at the surface. Elimination of auxiliary valving and control apparatus at the surface and downhole offers significant cost reduction in the system as well as economy in operation.

Simplicity of the system and its operation is enhanced by the superior lift capability, long life and accurate descent characteristics of the plunger. Furthermore, the plunger improves overall system performance.

The system is further simplified in the elimination of elaborate cushioning apparatus at the top and bottom of the tubing. Elimination of these parts is facilitated by the indestructibility of the plunger in combination with its reduced mass.

DETAILED DESCRIPTION OF THE DRAWINGS

Figure 1:
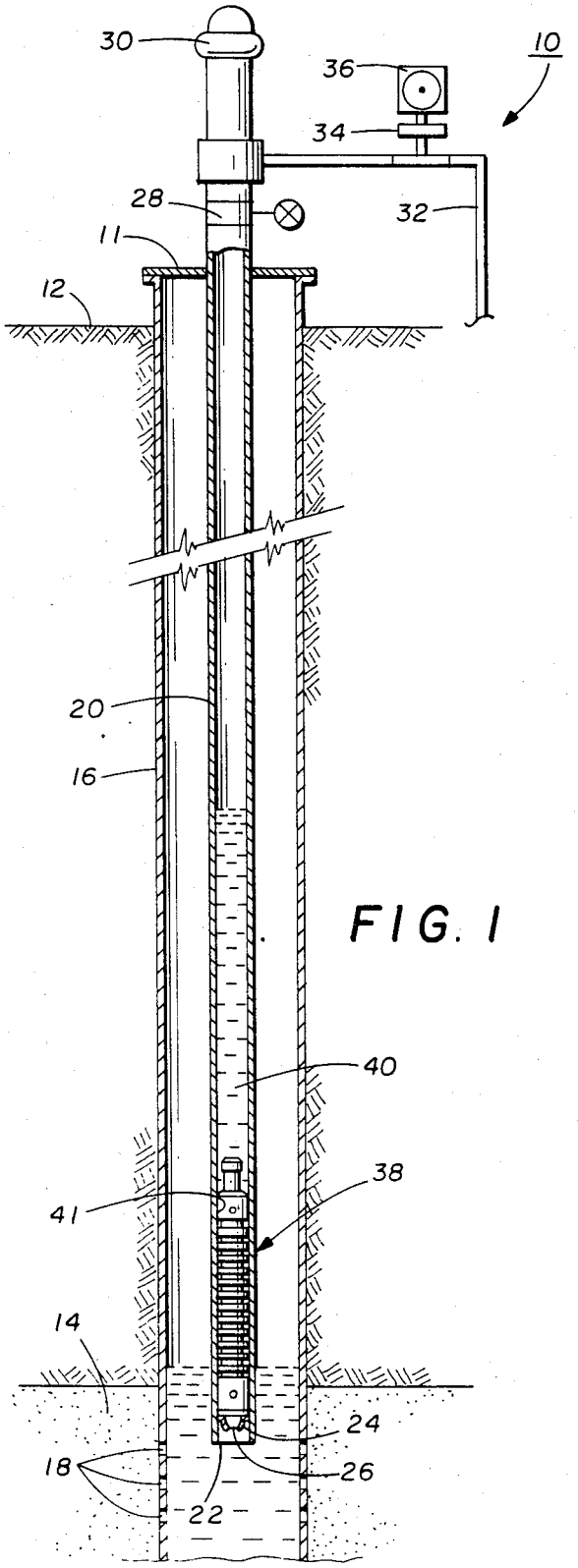
FIG. 1 diagrammatically illustrates a well equipped with the valveless free plunger of the present invention, and further illustrates a simplified well pumping system used in conjunction therewith.

There is shown in FIG. 1 an overall well pumping system 10 of the valveless free plunger type. A well 11 extends from ground level 12 down to a sub-surface, oil and gas bearing formation 14. The well includes an outer casing 16 having a plurality of apertures 18 formed through its sidewall adjacent formation 14 for admitting oil and gas. A string of tubing 20 extends down within the casing and has an open bottom 22. A seating nipple or abutment 24 is secured within the tubing and also has an open bottom 26. The top of the tubing extends through master valve 28 to bull plug collar 30 and to output flow line 32. Disposed in the flow line is a motor valve 34 operated by timer 36 between open and closed positions.

Valveless free plunger 38 is shown resting on nipple 24 at the beginning of a cycle of operation with motor valve 34 closed. Gas and oil from formation 14 enter casing 16 through apertures 18. There is gradually built up a slug of oil 40 within tubing 20 above plunger 38. The oil creeps upwardly around the plunger through annular clearance gap 41 between the plunger and the inner sidewall of tubing 20. As an alternative, the oil may also enter through apertures (not shown) formed in the tubing above the plunger. There is also a gradual buildup of formation gas pressure within the casing and tubing.

After a predetermined time lapse, timer 36 opens motor valve 34 which enables gas in the upper part of tubing 20 to escape through flow line 32. This creates a pressure differential across plunger 38, and the greater pressure beneath the plunger drives the plunger upwardly. The upwardly driven plunger drives slug 40 upwardly and outwardly through open flow line 32 to collection means (not shown).

When the plunger reaches the top, motor valve 34 is closed and the pressure on the top and bottom of the plunger equalizes. The plunger then falls under the influence of gravity slowly back down through the oil in the tubing and comes to rest against seating nipple 24. Motor valve 34 is again opened after a predetermined time, and the cycle is repeated.

The overall well pumping system and operation is simple and efficient. Complicated auxiliary valving and control apparatus at the surface and downhole are eliminated. Auxiliary cushioning apparatus at the upper and lower limits of the plunger travel stroke are also eliminated. System 10 is operated by a singular valve 34 at the surface in output flow line 32.

Figure 2:
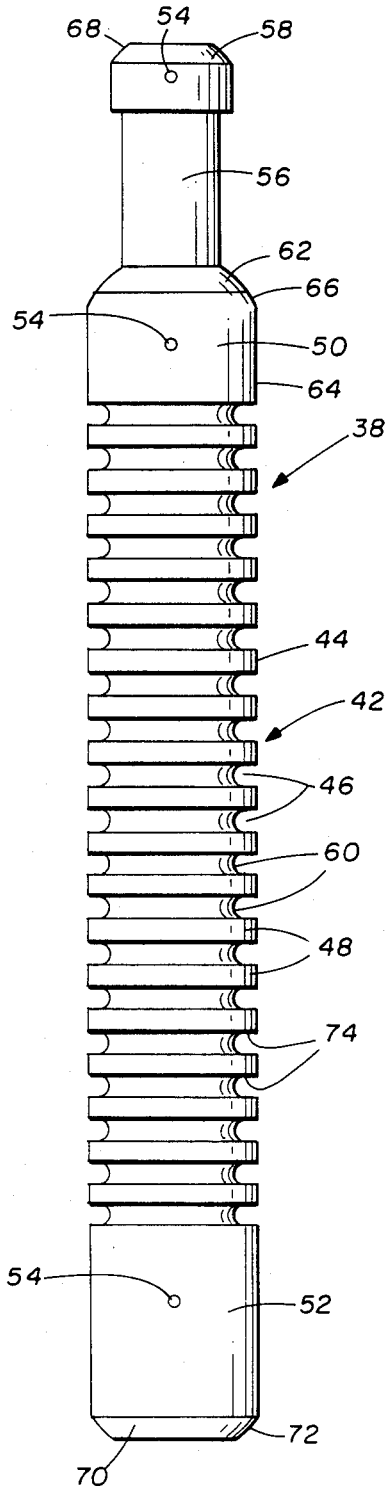
FIG. 2 is an enlarged front elevation view of the plunger of FIG. 1, and shows the preferred embodiment of a valveless free plunger constructed in accordance with the invention.

Referring to FIG. 2, valveless free plunger 38 comprises an elongated cylindrical aluminum body generally designated 42. This aluminum body is an integral member having a rigid sealing section 44 formed by a plurality of circumferential grooves 46 defining a plurality of annular sealing flanges 48. A pair of annular steel sleeves or collars 50 and 52 are secured to aluminum body 42 on opposite longitudinal sides of sealing section 44. Collars 50 and 52 have substantially the same outer diameter as sealing flanges 48. Each collar is secured by a pair of diametrically opposite set-screws such as 54. Alternative manners of securement, by way of example, not limitation, include pinning, welding and sweating (heating for expansion followed by cooling for reduction to a locking fit).

Integral aluminum body 42 further includes a fishing neck section 56 proximate collar 50 and of reduced outer diameter. A steel neck cap 58 is secured to the end of fishing neck section 56 opposite collar 50 and has a greater outer diameter than fishing neck section 56. Cap 58 is secured in the same manner as collars 50 and 52.

Exemplary dimensions will be given to facilitate a better understanding and appreciation of the invention. It is of course understood that the particular dimensions given are not constraints of the invention. Plunger 38 is used in 2 inch diameter tubing 20. The overall length of plunger 38 is 15.5 inches. The outer diameter of collars 50 and 52 and flanges 48 is 1.865 inches. Each of the grooves 46 has a curved inner surface 60 having a radius of curvature of 0.125 inch. The width of each flange 48 and each groove 46, taken along the longitudinal direction of elongated body 42, is substantially the same and is equal to 0.25 inch. There are approximately 2 grooves per inch longitudinal length of body 42. The inner diameter of each groove is 1.465 inches.

Fishing neck section 56 has a substantially uniform outer diameter of 1.187 inches. Integral aluminum body 42 has a curved transition section 62 of increasing diameter from fishing neck section 56 to collar 50. Collar 50 is an integral member having a main section 64 proximate sealing section 44 and a curved transition section 66 of decreasing outer diameter to meet curved transition section 62 of the aluminum body in smooth profile. The outer diameter of steel neck cap 58 is 1.375 inches. This cap has curved top surfaces 68. The bottom 70 of aluminum body 42 extends below collar 52 and has curved lower surfaces 72.

Plunger 38 is simple and economical to manufacture and provides improved performance characteristics. Aluminum body 42 provides both lightweight and ease of machinability. The reduced mass of the plunger increases net gas lift. Steel collars 50 and 52 provide wear resistance and protect annular aluminum sealing flanges 48. Initially set tolerances are maintained over an extended life rating because the outer diameter of annular aluminum sealing flanges 48 is maintained within set tolerances for as long as steel collars 50 and 52 maintain such tolerances. Set tolerances and maintenance thereof further affords accurate descent characteristics of the plunger. Furthermore, the plunger is rugged, durable and virtually indestructible.

Plunger 38 affords a groove and flange structure making effective use of gas pressure lift. Lift is generated in part by gas pressure accumulation in the grooves, forcing the plunger upwardly. As aforenoted, grooves 46 and flanges 48 are uniform and have the same width. The grooves and flanges are closely spaced to increase the number thereof per unit longitudinal length of body 42. The inner groove surfaces 60 are curved, and the radius of curvature is substantially one-half the groove width. Sealing characteristics are enhanced by the flanges cumulatively. The cumulative upper groove surface area 74 is optimized. There is thus provided further improved performance, all in a simple and manufacturably cost efficient device.

Simplicity of the overall well pumping system 10 and its operation is enhanced by the superior lift capability, long life and accurate descent characteristics of plunger 38. System performance is also improved by plunger 38. The operation of system 10 including the cycle of the plunger, is controlled singularly by surface valve 34.

In one particular system application with tubing 20 having a depth of 6,200 feet, and with 350 lbs. casing pressure, plunger 38 traveled from bottom to top in 7 minutes and lifted ½ bbl. of fluid. The descent time of the plunger was about 1 hour.

While the preferred embodiment has been described with particularity to better teach the invention, it is recognized that numerous modifications and alternatives are possible within the scope of the appended claims.

I claim:

1. A rugged lightweight valveless plunger for free plunger well pumping comprising;

(a) an elongated cylindrical aluminum body comprising:

(i) a sealing section extending substantially the length of the body and formed by a plurality of circumferential grooves defining a plurality of annular aluminum sealing flanges;

said grooves having the same width as the flanges and being closely spaced to increase the number thereof per unit of longitudinal length of the aluminum body, said grooves having curved inner surfaces each characterized by a radius equal to one-half the groove width;

(ii) a fishing neck section having a smaller diameter than said annular sealing flanges; and (iii) a curved transition section of increasing diameter from said fishing neck section to said sealing section;

(b) a pair of steel collars secured to said aluminum body on opposite longitudinal ends of said sealing section and having the same outer diameter as said annular sealing flanges;

(c) one of said collars having a main section proximate said annular sealing flanges and also having a curved transition section of decreasing outer diameter to meet said curved transition section of said aluminum body in smooth profile; and (d) a steel neck cap secured to the end of said fishing neck section opposite said one collar and having a greater outer diameter than said fishing neck section;

whereby the steel collars provide wear resistance and protection for the annular aluminum sealing flanges.

2. The plunger according to claim 1 wherein the neck cap, the upper collar and the lower collar are curved inwardly from an outer diameter.

* * * * *